US009784461B2

(12) United States Patent
Billman et al.

(10) Patent No.: US 9,784,461 B2
(45) Date of Patent: Oct. 10, 2017

(54) AIR CONDITIONER HEATER CONTROL BASED ON POWER SUPPLY CORD PARAMETERS

(71) Applicant: General Electric Company, Schenectady, NY (US)

(72) Inventors: David William Billman, Louisville, KY (US); Richard Dustin Henderson, La Grange, KY (US); Harold D. Moore, Louisville, KY (US)

(73) Assignee: Haier US Applicance Solutions, Inc., Wilmington, DE (US)

( * ) Notice: Subject to any disclaimer, the term of this patent is extended or adjusted under 35 U.S.C. 154(b) by 579 days.

(21) Appl. No.: 14/468,412

(22) Filed: Aug. 26, 2014

(65) Prior Publication Data

US 2016/0061501 A1 Mar. 3, 2016

(51) Int. Cl.
*F24F 11/00* (2006.01)
*F25B 13/00* (2006.01)

(52) U.S. Cl.
CPC ..... *F24F 11/0009* (2013.01); *F24F 2221/34* (2013.01); *F25B 13/00* (2013.01)

(58) Field of Classification Search
CPC .... F24F 11/0009; F24F 2221/34; F25B 13/00
See application file for complete search history.

(56) References Cited

U.S. PATENT DOCUMENTS 5,197,667 A * 3/1993 Bowsky ..... F24F 11/0009 236/49.3
5,838,776 A * 11/1998 Adkins, II ..... H04L 12/2818 307/39
2003/0151309 A1* 8/2003 Hutton ..... H02J 3/14 307/31
2003/0160594 A1* 8/2003 Trinh ..... H02J 7/0081 320/156
2005/0173401 A1* 8/2005 Bakanowski ..... F24C 7/087 219/412
2006/0164773 A1* 7/2006 Stanford ..... H04L 49/351 361/93.1
2007/0238341 A1* 10/2007 So ..... H01R 13/447 439/172
2008/0237217 A1* 10/2008 Helt ..... F24H 3/002 219/485

(Continued)

FOREIGN PATENT DOCUMENTS

JP 7233996 A 9/1995
JP 2004190900 A 7/2004

*Primary Examiner* — Christopher E Everett
(74) *Attorney, Agent, or Firm* — Dority & Manning, P.A.

(57) ABSTRACT

Air conditioner units and methods of operating the same are provided. One example method includes determining whether one or more heaters included in the air conditioner unit are energized. The method includes determining whether an operating speed of a fan included in the air conditioner unit is less than a threshold speed. The method includes determining whether a power provided to the air conditioner unit by a utilized power supply cord is greater than a threshold power. The method includes de-energizing at least one of the one or more heaters when it is determined that the one or more heaters are energized, the operating speed of the fan is less than the threshold speed, and the power provided by the utilized power supply cord is greater than the threshold power.

18 Claims, 4 Drawing Sheets

(56) References Cited

U.S. PATENT DOCUMENTS

| | | | | |
|---|---|---|---|---|
| 2009/0160664 | A1* | 6/2009 | Martin-Otto | G06F 1/26 340/657 |
| 2009/0179080 | A1* | 7/2009 | Alston | B60H 1/00378 237/28 |
| 2011/0062142 | A1* | 3/2011 | Steurer | H05B 1/0266 219/483 |
| 2011/0153090 | A1* | 6/2011 | Besore | G05B 15/02 700/278 |
| 2011/0264274 | A1* | 10/2011 | Grabinger | F24F 11/0001 700/276 |
| 2012/0230839 | A1* | 9/2012 | Hussey | F04D 27/001 417/42 |
| 2015/0057811 | A1* | 2/2015 | Fan | F24F 11/0079 700/276 |

* cited by examiner

AIR CONDITIONER HEATER CONTROL BASED ON POWER SUPPLY CORD PARAMETERS

FIELD OF THE INVENTION

The present disclosure relates generally to air conditioner units. More particularly, the present disclosure relates to control of heaters in air conditioner units based on power supply cord parameters to prevent overheating of the unit.

BACKGROUND OF THE INVENTION

Certain air conditioner units according to the present disclosure may include a plurality of heaters (e.g. a plurality of coils that respectively generate heat when energized). The plurality of heaters can operate at the same or different wattages. To control an amount of heat generated by the air conditioner unit when operating in a heating mode, one of a plurality of different power supply cords may be selected and used to power the air conditioner unit.

More particularly, the plurality of different supply cords may have identical interfaces that are able to be interchangeably coupled with a power input interface of the air conditioner unit. However, the power supply cords may include different internal wirings that result in different combinations of the air conditioner unit heaters being energized when the unit is placed in the heating mode. In addition, the different power supply cords may be rated for or otherwise capable of providing power at different amperages.

As an example, for certain existing air conditioner units, three different power supply cords may be available. A first, 15-ampere power supply cord may result in a first lower wattage heater and a second medium wattage heater of the air conditioner unit being energized when the unit is placed in the heating mode. A second, 20-ampere power supply cord may result in the first lower wattage heater and a third higher wattage heater being energized when the unit is placed in the heating mode. Finally, a third, 30-ampere power supply cord may result in the each of the first, second, and third heaters being energized when the unit placed in the heating mode.

Thus, by selecting from among the first, second, and third power supply cords, the operator of the air conditioner unit can control an amount of heat that is produced by the air conditioner unit when it is operated in the heating mode.

However, unit overheating may occur in limited situations in which the third, 30-ampere power supply cord is utilized. In particular, when all three heaters are energized and the fan speed of the air conditioner unit is set to a low setting, the air conditioner unit may be hotter than in other operating conditions. For example, if an airflow disruption occurs (e.g. a blockage across an air flow input and/or airflow output of the unit), the bulkhead temperatures of the air conditioner unit may exceed normal levels, resulting in deformation of the unit. Generally, however, such concerns are not present when only the first and second or the first and third heaters are energized.

Therefore, systems and methods are needed for detecting if a particular power supply cord associated with elevated heater output is being used to power an air conditioner appliance.

BRIEF DESCRIPTION OF THE INVENTION

Aspects and advantages of the invention will be set forth in part in the following description, or may be obvious from the description, or may be learned through practice of the invention.

One aspect of the present disclosure is directed to a method for operating an air conditioner unit. The method includes determining whether one or more heaters included in the air conditioner unit are energized. The method includes determining whether an operating speed of a fan included in the air conditioner unit is less than a threshold speed. The method includes determining whether a power provided to the air conditioner unit by a utilized power supply cord is greater than a threshold power. The method includes de-energizing at least one of the one or more heaters when it is determined that the one or more heaters are energized, the operating speed of the fan is less than the threshold speed, and the power provided by the utilized power supply cord is greater than the threshold power.

Another aspect of the present disclosure is directed to an air conditioner unit. The air conditioner unit includes one or more heaters. The air conditioner unit includes a fan for inducing airflow across the one or more heaters. The air conditioner unit includes a power input interface for receiving power from a utilized power supply cord that is electrically connected to the power input interface. The power input interface includes a plurality of electrical connections. The utilized power supply cord is one of a plurality of different power supply cords that are interchangeable for providing power to the power input interface. The plurality of different power supply cords are capable of respectively providing power at a plurality of different amperages. The air conditioner unit includes one or more processors. The air conditioner unit includes one or more non-transitory computer-readable media storing instructions that, when executed by the one or more processors, cause the air conditioner unit to perform operations. The operations include determining whether the one or more heaters are energized. The operations include determining whether an operating speed of the fan is less than a threshold speed. The operations include determining whether a first amperage of the power provided by the utilized power supply cord is greater than a threshold amperage. The operations include de-energizing at least one of the one or more heaters when it is determined that the one or more heaters are energized, the operating speed of the fan is less than the threshold speed, and the first amperage of the power is greater than the threshold amperage.

Another aspect of the present disclosure is directed to one or more non-transitory computer-readable media storing instructions that, when executed by one or more processors, cause an air conditioner unit to perform operations. The operations include determining whether an air conditioner unit is operating in a heating mode or a cooling mode. The operations include, when it is determined that the air conditioner unit is operating in the heating mode, determining whether a fan speed setting of the air conditioner unit is set to a low fan speed setting. The operations include, when it is determined that the fan speed setting of the air conditioner unit is set to the low fan speed setting, determining whether a first amperage at which a utilized power supply cord is supplying power to the air conditioner unit is greater than a threshold amperage. The operations include, when it is determined that the first amperage is greater than the threshold amperage, disabling at least one heater included in the air conditioner unit.

These and other features, aspects and advantages of the present invention will be better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
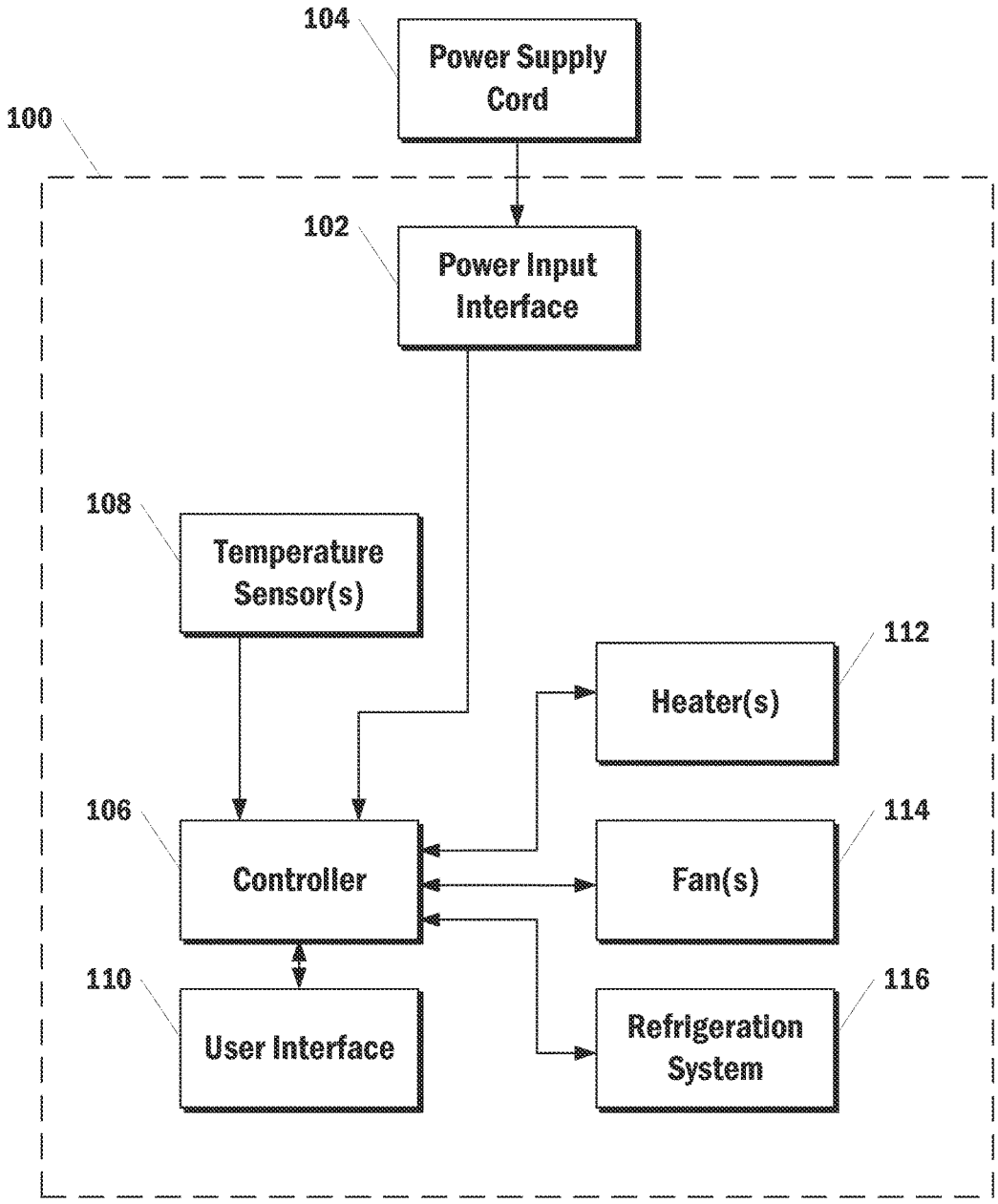
FIG. 1 depicts a simplified block diagram of an example air conditioner unit control system according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure is directed to air conditioner units and methods of operation thereof in which overheating conditions are prevented by monitoring power parameters associated with a power supply cord and controlling operation of one or more heaters based on a combination of operating parameters including the power parameters. One example method includes determining whether one or more heaters included in the air conditioner unit are energized. The method includes determining whether an operating speed of a fan included in the air conditioner unit is less than a threshold speed. The method includes determining whether a power provided to the air conditioner unit by a utilized power supply cord is greater than a threshold power. The method includes de-energizing at least one of the one or more heaters when it is determined that the one or more heaters are energized, the operating speed of the fan is less than the threshold speed, and the power provided by the utilized power supply cord is greater than the threshold power.

As an example, in some embodiments, determining whether the power provided to the air conditioner unit by the utilized power supply cord is greater than the threshold power can be accomplished by determining whether the power supplied by the utilized power supply cord has an amperage that exceeds a threshold amperage. For example, the utilized power supply cord providing power to the air conditioner unit can be one of a plurality of different power supply cords that are capable of interchangeable use with the air conditioner unit. The plurality of different power supply cords are capable of respectively providing power at a plurality of different amperages. Thus, in some embodiments, determining whether the power supplied by the utilized power supply cord has an amperage that exceeds the threshold amperage can be accomplished by determining which of the plurality of different power supply cords has been utilized.

As an example, in some embodiments, the plurality of different power supply cords can include a first set of power supply cords that are capable of supplying power at amperages that are greater than the threshold amperage and can include a second set of power supply cords that are not capable of supplying power at amperages that are greater than the threshold amperage. Thus, in some embodiments, determining whether the power provided to the air conditioner unit by the utilized power supply cord is greater than the threshold power can be accomplished by determining a voltage at a first electrical connection between the utilized power supply cord and a power input interface of the air conditioner unit. In particular, the voltage at the first electrical connection can be a first value when the utilized power supply cord belongs to the first set of power supply cords and the voltage at the first electrical connection can be a second value when the utilized power supply cord belongs to the second set of power supply cords, where the first value is different than the second value.

For example, the power input interface of the air conditioner unit can include a plurality of electrical connections that respectively connect to a plurality of output connections of the utilized power supply cord. Each of the power supply cords that belong to the first set include one or more wiring jumpers that cause a positive voltage to be provided at the first connection. In contrast, each of the power supply cords that belong to the second set do not include one or more wiring jumpers supplying power to the first connection. Thus, a zero voltage is provided at the first connection when a power supply cord that belongs to the second set is used.

Therefore, by determining the voltage at the first electrical connection, it can be determined whether the power supply cord currently supplying power to the air conditioner unit is providing power having an amperage above or below the threshold amperage. The control of the one or more heaters can be adjusted based at least in part on such determination. In particular, in some embodiments, at least one of the one or more heaters can be de-energized when it is determined that the one or more heaters are energized, the operating speed of the fan is less than the threshold speed, and the power provided by the utilized power supply cord is greater than the threshold power.

With reference now to the FIGS., example embodiments of the present disclosure will be discussed in further detail.

FIG. 1 depicts a simplified block diagram of an example air conditioner unit control system 100 according to an example embodiment of the present disclosure. As used herein, an "air conditioner unit" can refer to any machine or appliance for moderating air temperature or humidity, including, for example, stand-alone heaters (e.g. space heaters), traditional HVAC systems, or other such devices. In some embodiments of the present disclosure, the air conditioner unit can be a combination packaged terminal air conditioner and packaged terminal heat pump.

Control system 100 can include a power input interface 102. The power input interface 102 can receive power from a power supply cord 104. For example, the power supply cord 104 can transmit alternating current power from a utility outlet to the power input interface 102 of the air conditioner unit. In some embodiments, the alternating current power can have a voltage at about 208 to 230 volts.

The power input interface 102 can supply the received power to various components of the air conditioner unit. For example, the alternating current power can be supplied directly to various components such as, for example, one or more heaters 112, one or more fans 114, and/or a refrigeration system 116. As another example, the power input interface 102 can include components for transforming the received alternating current power into direct current power of a lower voltage (e.g. rectifiers, voltage transformers, etc.). For example, the direct current power can be provided to a controller 106 and/or a user interface 110.

The controller 106 can control operations of the air conditioner unit. In particular, the controller 106 can control or otherwise manipulate the supply of power to the heaters 112, the fans 114, and/or the refrigeration system 116. For example, the controller 106 can operate one or more switching elements (e.g. TRIACS, relays, switches, IGBTs, etc.) to selectively allow or disallow the flow of energy to such components.

The controller 106 can include one or more processing devices such as, for example, microprocessors, integrated circuits, ASICs, microcontrollers, or other processing devices. The controller 106 can include one or more non-transitory computer readable media (e.g. RAM, ROM, flash memory, or other data storage devices or components) that store instructions. The memory media can be co-located with the processing devices or can be located remotely. The processing devices can implement instructions stored in the memory media to perform operations. For example, controller 106 can implement instructions stored in memory to perform method 500 of FIG. 5.

The controller 106 can be connected to or otherwise able to obtain readings from one or more temperature sensors 108. For example, the temperature sensor 108 can be positioned in a path of incoming airflow into the air conditioner unit. Thus, output from the temperature sensor 108 located at such position can provide an indication of an ambient indoor air temperature. Other positions can be used to determine ambient indoor air temperature as well. As another example, the temperature sensor 108 can be positioned in a path for outgoing airflow from the air conditioner unit. Thus, output from the temperature sensor 108 located at such position can provide an indication of an internal temperature within the bulkhead of the air conditioner unit.

The controller 106 can also be connected to or otherwise receive signals from a user interface 110. User interface 110 can provide the ability for a user of the air conditioner unit to change one or more settings or control parameters of the air conditioner unit. As an example, in some embodiments the user interface 110 can include one or more buttons, dials, or other user input features to allow the user to control the operation of the air conditioner unit. For example, the user interface 110 may allow the user to control whether the air conditioner unit operates in a cooling mode or a heating mode. Further, the user interface 110 may allow the user to control and fan speed setting. The controller 106 can control operation of the various components of the air conditioner unit based on signals received from the user interface 110.

The heaters 112 can include one or more heating elements that generates heat when energized. As an example, in some embodiments of the present disclosure, the heaters 112 can include a first, second, and third heater that operate at different wattages. For example, each of the first, second, and third heaters can be a coiled nichrome wire. In particular, as an example, the first heater can operate at 1.0 KW; the second heater can operate at 1.4 KW; and the third heater can operate at 2.4 KW.

The fans 114 can include one or more fans positioned to induce airflow through the air conditioner unit. For example, in some embodiments, the fans 114 can be operated to induce airflow across the heaters 112 and/or an evaporator of the refrigeration system 116.

The refrigeration system 116 can include components for performing a traditional refrigeration cycle. For example, in some embodiments, the refrigeration system 116 can be a sealed refrigeration system that includes components such as a compressor, a condenser, an evaporator, and an expansion valve.

According to an aspect of the present disclosure, the controller 106 can control operation of the heaters 112 based on parameters of the power supplied by the power supply cord 104. As an example, the controller 106 may de-energize one or more of the heaters 112 when the heaters 112 are operating, the fans 114 are operating below a threshold speed level, and the power supplied by the power supply cord 104 exceeds a threshold power.

In particular, by determining a first voltage at a first electrical connection between the power input interface 102 and the power supply cord 104, the controller 106 or other system components may determine which of a plurality of different, interchangeable power supply cords is being utilized. More particularly, based on the first voltage at power input interface 102 it can be determined whether the power supply cord 104 is rated to provide power having amperages above or below a threshold amperage.

If the power supply cord 104 is determined to be rated for amperages exceeding the threshold amperage and various other conditions are met, then the controller 106 can de-energize at least one of the one or more heaters 112, thereby reducing a risk of overheating the air conditioner unit.

Figure 2:
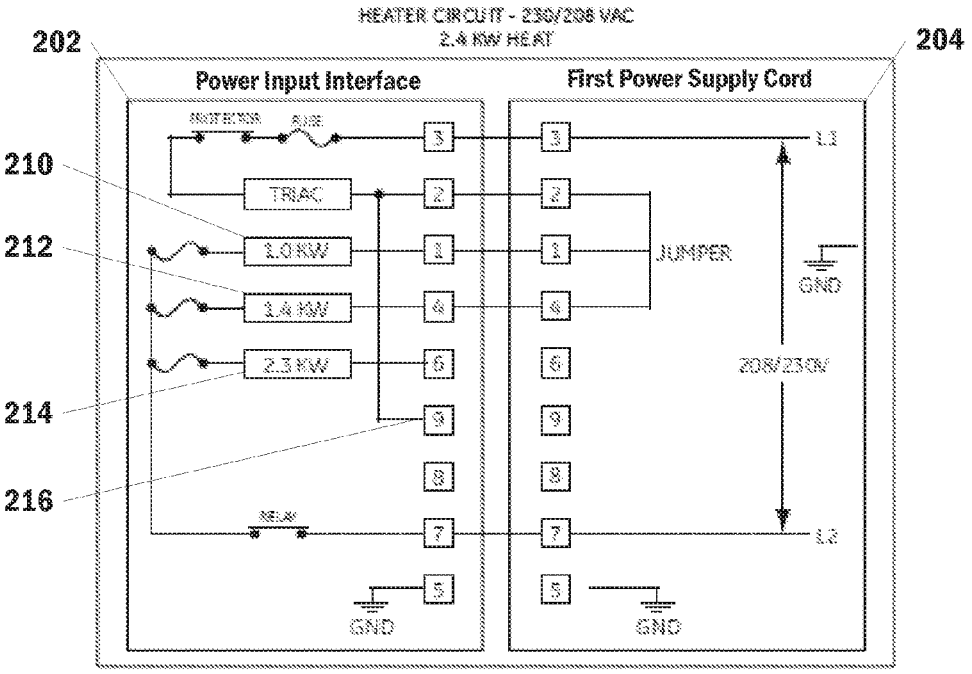
FIG. 2 depicts a schematic of a power input interface receiving power from a first power supply cord according to an example embodiment of the present disclosure.

FIG. 2 depicts a schematic of a power input interface 202 receiving power from a first power supply cord 204 according to an example embodiment of the present disclosure. In particular, the first power supply cord 204 is rated to provide 208/230 volt alternating current power at about 15 amperes. The particular values for power supply cords (e.g. 15, 20, and 30 ampere ratings) and heaters discussed herein are provided as examples only, the present disclosure can be applied to many different components exhibiting many different parameters.

As shown in the schematic of FIG. 2, the power input interface 202 includes nine input connections or pins. Likewise, the first power supply cord 204 includes nine output connections. Thus, the first power supply cord 204 can be mated to the power input interface 202.

The first power supply cord 204 also includes wiring jumpers or other forms of securing or providing electrical connection that result in electrical connection between output connections 1, 2, and 4 at the first power supply cord 204. This arrangement results in a first, 1.0 KW heater 210 and a second, 1.4 KW heater 212 being energized when the heaters are operated. However, this arrangement does not result in a third, 2.3 KW heater 214 being energized when the heaters are operated.

According to an aspect of the present disclosure, the first power supply cord 204 does not including wiring jumpers that result in energy being present at the ninth input connection 216 of the power input interface 202. Thus, when the heaters are operating, the voltage at the ninth input connection 216 of the power input interface 202 is at about zero.

Figure 3:
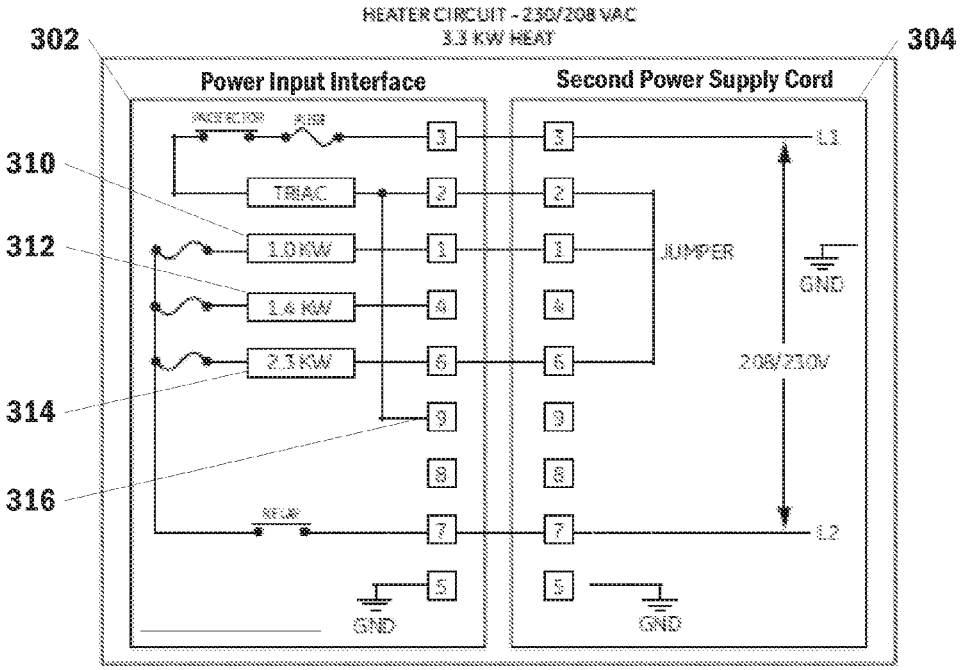
FIG. 3 depicts a schematic of a power input interface receiving power from a second power supply cord according to an example embodiment of the present disclosure.

FIG. 3 depicts a schematic of a power input interface 302 receiving power from a second power supply cord 304 according to an example embodiment of the present disclosure. In particular, the second power supply cord 304 is rated to provide 208/230 volt alternating current power at about 20 amperes.

As shown in the schematic of FIG. 3, the power input interface 302 includes nine input connections or pins. Likewise, the second power supply cord 304 includes nine output connections. Thus, the second power supply cord 304 can be mated to the power input interface 302.

The second power supply cord 304 also includes wiring jumpers or other forms of securing or providing electrical connection that result in electrical connection between output connections 1, 2, and 6 at the second power supply cord 304. This arrangement results in a first, 1.0 KW heater 310 and a third, 2.3 KW heater 314 being energized when the heaters are operated. However, this arrangement does not result in a second, 1.4 KW heater 312 being energized when the heaters are operated.

According to an aspect of the present disclosure, the second power supply cord 304 does not including wiring jumpers that result in energy being present at the ninth input connection 316 of the power input interface 302. Thus, when the heaters are operating, the voltage at the ninth input connection 316 of the power input interface 302 is at about zero.

Figure 4:
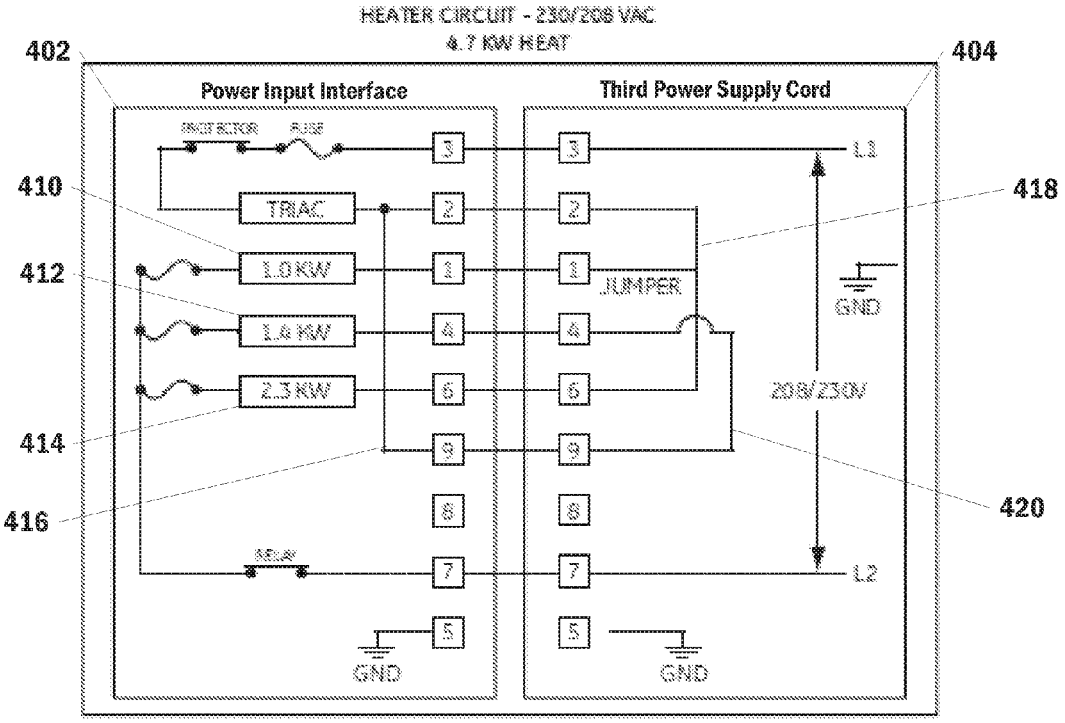
FIG. 4 depicts a schematic of a power input interface receiving power from a third power supply cord according to an example embodiment of the present disclosure.

FIG. 4 depicts a schematic of a power input interface 402 receiving power from a third power supply cord 404 according to an example embodiment of the present disclosure. In particular, the third power supply cord 404 is rated to provide 208/230 volt alternating current power at about 30 amperes.

As shown in the schematic of FIG. 4, the power input interface 402 includes nine input connections or pins. Likewise, the third power supply cord 404 includes nine output connections. Thus, the third power supply cord 404 can be mated to the power input interface 402.

The third power supply cord 404 also includes wiring jumpers or other forms of securing or providing electrical connection that result in electrical connection between various of its output terminals. For example, a first jumper 418 electrically connects output connections 1, 2, and 6 at the third power supply cord 404. These connections by the first jumper 418 result in a first, 1.0 KW heater 410 and a third, 2.3 KW heater 414 being energized when the heaters are operated.

A second jumper 420 electrically connects output connections 4 and 9 at the third power supply cord 404. This connection by the second jumper 420 results in a second, 1.4 KW heater 412 being energized when the heaters are operated.

In addition, according to an aspect of the present disclosure, the inclusion of the second jumper 420 in the third power supply cord 404 results in a non-zero voltage being present at the ninth input connection 416 of the power input interface 402 when the heaters are energized.

Thus, by sampling or otherwise determining a voltage at the ninth input connection of the power input interface, it can be determined whether the first power supply cord 202, the second power supply cord 302, or the third power supply cord 404 is being utilized to provide power to the air conditioner unit. As a consequence, the voltage at the ninth input connection can be indicative of whether the power provided to air conditioner unit is provided at 30 amperes or 15 or 20 amperes.

Figure 5:
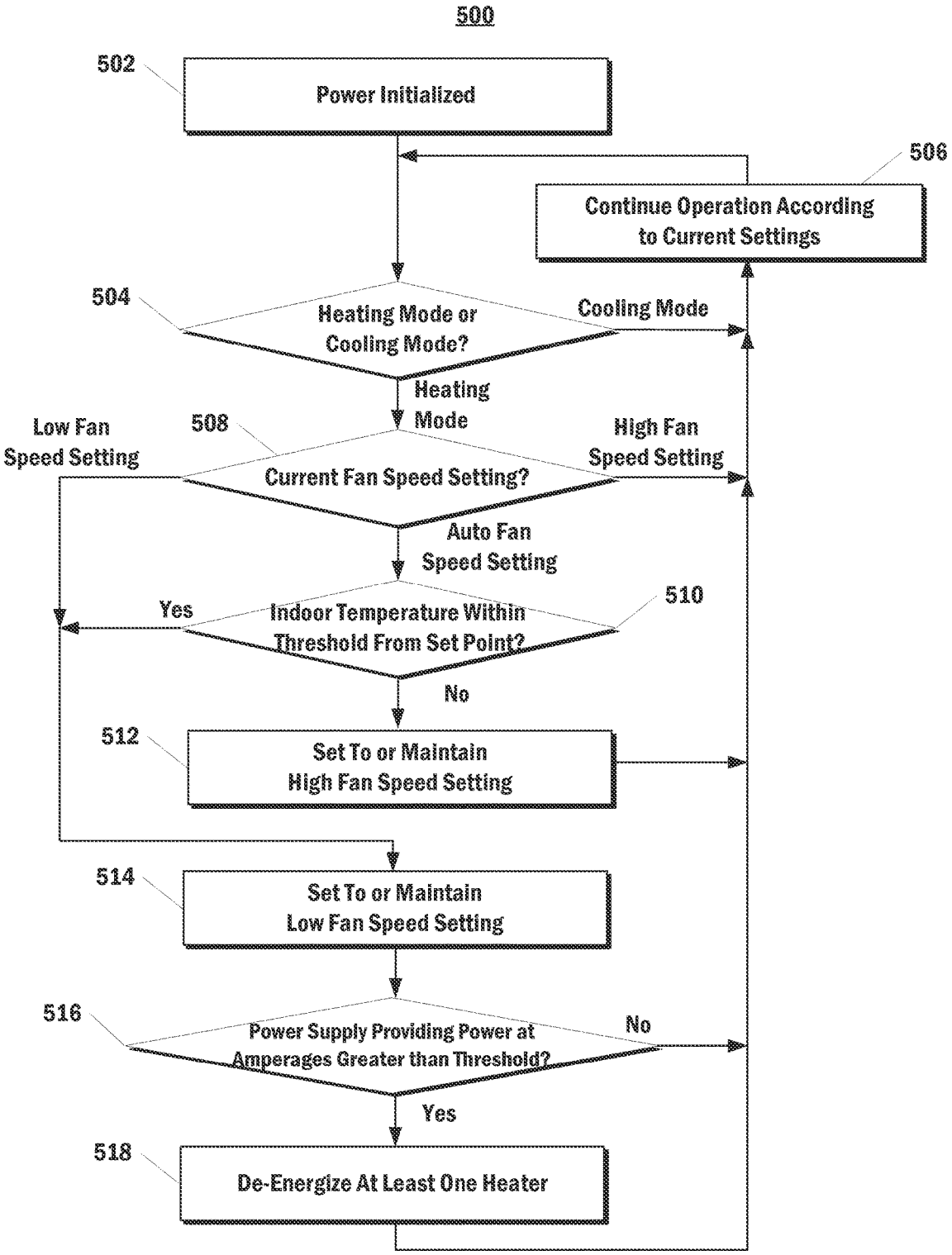
FIG. 5 depicts a flow chart of an example method of operating an air conditioner unit according to an example embodiment of the present disclosure.

FIG. 5 depicts a flow chart of an example method 500 of operating an air conditioner unit according to an example embodiment of the present disclosure. Although FIG. 5 depicts steps performed in a particular order for purposes of illustration and discussion, various steps of the method 500 can be omitted, rearranged, combined, and/or adapted in various ways without deviating from the scope of the present disclosure. In some embodiments, method 500 can be periodically or continually implemented as a software routine in a controller of an air conditioner unit.

At 502 power to the air conditioner unit can be initialized. For example, the air conditioner unit may be switched on or otherwise powered (e.g. receive utility power via a power supply cord).

At 504 can be determined whether the air conditioner unit is currently set in a heating mode or a cooling mode. For example, a controller can interact with a user interface or can read an internal flag or memory to determine the current heating or cooling setting of the air conditioner unit.

If it is determined at 504 that the air conditioner unit is currently set in the cooling mode, then method 500 can proceed to 506 and continue operation of the air conditioner unit according to current settings. After 506, method 500 can loop back to 504.

However, if it is determined at 504 that the air conditioner unit is currently set in the heating mode, then method 500 can proceed to 508.

At 508 a current fan speed setting can be determined. For example, a controller can interact with a user interface or can read an internal flag or memory to determine the current fan setting of the air conditioner unit.

If it is determined at 508 that the air conditioner unit is currently operating according to a high fan speed setting, then method 500 can proceed to 506 and continue operation of the air conditioner unit according to current settings.

However, if it is determined at 508 that the air conditioner unit is currently operating according to the low fan speed setting, then method 500 can proceed to 514.

Still referring to 508, if it is determined at 508 that the air conditioner unit is currently operating according to an auto fan speed setting, then method 500 can proceed to 510. At 510 it can be determined whether an indoor temperature is within a threshold amount from a set point temperature. For example, output from a temperature sensor positioned in a path of incoming airflow to the air conditioner unit or positioned external to the air conditioner unit can be used to determine the indoor temperature. The indoor temperature can be compared to a set point temperature obtained from a local memory or received from a user interface.

If it is determined at 510 that the indoor temperature is not within the threshold amount from the setpoint temperature, then method 500 can proceed to 512. At 512 the air conditioner unit can be set to or maintained at a high fan speed setting. After 512, method 500 can proceed to 506 and continue operation of the air conditioner unit according to current settings.

However, referring again to 510, it is determined at 510 that the indoor temperature is within the threshold amount from the setpoint temperature, then method 500 can proceed to 514. At 514 the air conditioner unit can be set to or maintained at a low fan speed setting.

At 516 can be determined whether a power supply cord being utilized is providing power at amperages greater than a threshold amperage. For example, in some embodiments, a plurality of different but interchangeable power supply cords can be used to power the air conditioner unit. In particular, the plurality of different power supply cords can respectively provide power at a plurality of different amperages (e.g. 15, 20, and 30). Some available amperages (e.g. 15 and 20) may be below a threshold amperage while other available amperages (e.g. 30) may be above the threshold amperage. Thus, in some embodiments, the determination performed at 516 can be accomplished by determining which of the different power supply cords is being utilized to power the air conditioner unit.

In particular, in some embodiments, the power supply cords rated for amperages above the threshold amperage may include wiring that results in a non-zero voltage being present at a particular electrical connection between the power supply cord and a power input interface of the air conditioner unit when the heaters are being operated. In contrast, the power supply cords rated for amperages below the threshold amperage may result in a zero voltage being present at such particular electrical connection. Thus, in some embodiments, the particular type of power supply cord being utilized can be determined at 516 by sampling or otherwise reading a voltage at such particular electrical connection.

Referring again to 516, if it is determined at 516 that the power supply cord being utilized is not providing power at amperages greater than a threshold amperage, then method 500 can proceed to 506 and continue operation of the air conditioner unit according to current settings.

However, if it is determined at 516 that the power supply cord being utilized is providing power at amperages greater than a threshold amperage, then method 500 can proceed to 518. At 518 at least one heater of the air conditioner unit can be de-energized. For example, a lowest wattage heater of three different heaters can be de-energized at 518. However, other heaters or other combinations of heaters can be de-energized at 518 as well. In such fashion, overheating conditions associated with maximum wattage heater use and low fan speed can be eliminated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating an air conditioner unit, the method comprising:

determining whether one or more heaters included in the air conditioner unit are energized;

determining whether an operating speed of a fan included in the air conditioner unit is less than a threshold speed;

determining a power rating of a utilized power supply cord that is used to provide power to the air conditioner unit;

determining whether the power rating of the utilized power supply cord is greater than a threshold power; and when it is determined that the one or more heaters are energized, the operating speed of the fan is less than the threshold speed, and the power rating of the utilized power supply cord is greater than the threshold power: de-energizing at least one of the one or more heaters.

2. The method of claim 1, wherein determining the power rating of the utilized power supply cord comprises determining an amperage rating of the utilized power supply cord, and wherein determining whether the power rating of the utilized power supply cord is greater than the threshold power comprises determining whether the amperage rating of the utilized power supply cord exceeds a threshold amperage.

3. The method of claim 2, wherein:

the utilized power supply cord is one of a plurality of different power supply cords that are capable of interchangeable use with the air conditioner unit, wherein the plurality of different power supply cords are capable of respectively providing power at a plurality of different amperages; and determining the power rating of the utilized power supply comprises determining which of the plurality of different power supply cords has been utilized.

4. The method of claim 1, wherein:

the utilized power supply cord is one of a plurality of different power supply cords that are capable of interchangeable use with the air conditioner unit, wherein the plurality of different power supply cords are capable of respectively providing power at a plurality of different amperages;

the plurality of different power supply cords comprise a first set of power supply cords that are capable of supplying power at amperages that are greater than a threshold amperage and a second set of power supply cords that are not capable of supplying power at amperages that are greater than the threshold amperage; and determining the power rating of the utilized power supply cord comprises determining a voltage at a first electrical connection between the utilized power supply cord and a power input interface of the air conditioner unit, wherein the voltage at the first electrical connection is a first value when the utilized power supply cord belongs to the first set of power supply cords, and wherein the voltage at the first electrical connection is a second value when the utilized power supply cord belongs to the second set of power supply cords, the first value being different than the second value.

5. The method of claim 4, wherein:

the power input interface of the air conditioner unit comprises a plurality of electrical connections that respectively connect to a plurality of output connections of the utilized power supply cord;

each of the first set of power supply cords include one or more wiring jumpers that cause a positive voltage to be provided at the first connection; and each of the second set of power supply cords do not include one or more wiring jumpers supplying power to the first connection, such that a zero voltage is provided at the first connection.

6. The method of claim 1, wherein:

the one or more heaters comprise a first heater, a second heater, and a third heater;

the first heater operates at a first wattage;

the second heater operates at a second wattage that is greater than the first wattage;

the third heater operates a third wattage that is greater than the second wattage; and de-energizing at least one of the one or more heaters comprises de-energizing only the first heater.

7. The method of claim 1, wherein determining whether the one or more heaters included in the air conditioner unit are energized comprises determining, by a controller of the air conditioner unit, whether the air conditioner unit is operating in a heating mode.

8. The method of claim 1, wherein determining whether the operating speed of the fan included in the air conditioner unit is less than the threshold speed comprises determining, by a controller of the air conditioner unit, whether the air conditioner unit is operating in a low fan speed mode, wherein the air conditioner unit is operable in at least a low fan speed mode and a high fan speed mode.

9. The method of claim 8, wherein determining, by the controller of the air conditioner unit, whether the air conditioner unit is operating in the low fan speed mode comprises determining, by the controller of the air conditioner unit, whether an ambient indoor temperature is within a threshold amount from a set point temperature, wherein the air conditioner operates in the low fan speed mode when the ambient indoor temperature is within the threshold amount from the set point temperature.

10. The method of claim 1, further comprising, when it is determined that the one or more heaters are not energized, the operating speed of the fan is not less than the threshold speed, or the power provided by the utilized power supply cord is not greater than the threshold power: maintaining operating of the air conditioner unit according to one or more current settings.

11. An air conditioner unit, comprising:

one or more heaters;

a fan for inducing airflow across the one or more heaters;

a power input interface for receiving power from a utilized power supply cord that is electrically connected to the power input interface and that supplies power to the air conditioner unit, wherein the power input interface comprises a plurality of electrical connections, and wherein the utilized power supply cord comprises one of a plurality of different power supply cords that are interchangeable for providing power to the power input interface, the plurality of different power supply cords being capable of respectively providing power at a plurality of different amperages;

one or more processors; and one or more non-transitory computer-readable media storing instructions that, when executed by the one or more processors, cause the air conditioner unit to perform operations, the operations comprising:

determining whether the one or more heaters are energized;

determining whether an operating speed of the fan is less than a threshold speed;

determining an amperage rating of the utilized power supply cord;

determining whether the amperage rating of the utilized power supply cord is greater than a threshold amperage; and de-energizing at least one of the one or more heaters when it is determined that the one or more heaters are energized, the operating speed of the fan is less than the threshold speed, and the amperage rating of the utilized power supply cord is greater than the threshold amperage.

12. The air conditioner unit of claim 11, wherein determining the amperage rating of the utilized power supply cord comprises determining a first voltage at a first electrical connection of the plurality of electrical connections of the power input interface.

13. The air conditioner unit of claim 12, wherein:

the first voltage comprises a first value when the amperage rating of the utilized power supply cord is greater than the threshold amperage;

the first voltage comprises a second value when the amperage rating of the utilized power supply cord is not greater than the threshold amperage;

the first value is greater than the second value.

14. The air conditioner unit of claim 13, wherein:

the plurality of different power supply cords comprise a first set of power supply cords and a second set of power supply cords;

the first set of power supply cords respectively supply power at amperages that are greater than the threshold amperage;

the second set of power supply cords respectively do not supply power at amperages that are greater than the threshold amperage; and each of the first set of power supply cords comprises one or more wiring jumpers that cause the first voltage to comprise the first value when power is supplied to the air conditioner unit.

15. One or more non-transitory computer-readable media storing instructions that, when executed by one or more processors, cause an air conditioner unit to perform operations, the operations comprising:

determining whether an air conditioner unit is operating in a heating mode or a cooling mode;

when it is determined that the air conditioner unit is operating in the heating mode, determining whether a fan speed setting of the air conditioner unit is set to a low fan speed setting;

when it is determined that the fan speed setting of the air conditioner unit is set to the low fan speed setting, determining whether a first amperage at which a utilized power supply cord is supplying power to the air conditioner unit is greater than a threshold amperage wherein determining whether the first amperage at which the utilized power supply cord is supplying power to the air conditioner unit is greater than the threshold amperage comprises determining a first voltage at a first electrical connection of a power input interface that receives the power from the utilized power supply cord, wherein the first voltage is greater than a threshold voltage when the utilized power supply cord is rated to provide amperages greater than the threshold amperage; and when it is determined that the first amperage is greater than the threshold amperage, disabling at least one heater included in the air conditioner unit.

16. The one or more non-transitory computer-readable media of claim 15, wherein the first voltage at the first electrical connection of the power input interface is greater than the threshold voltage only when the utilized power supply cord is rated to provide amperages greater than the threshold amperage.

17. The one or more non-transitory computer-readable media of claim 15, wherein the utilized power supply cord comprises one or more jumpers that provide non-zero voltage to the first electrical connection only when the utilized power supply cord is rated to provide amperages greater than the threshold amperage.

18. The one or more non-transitory computer-readable media of claim 15, wherein disabling the at least one heater included in the air conditioner unit comprises disabling a first heater included in the air conditioner, the air conditioner having a second heater and a third heater in addition to the first heater.

* * * * *